US005262592A

United States Patent [19]

Aldissi

[11] Patent Number: 5,262,592

[45] Date of Patent: Nov. 16, 1993

[54] FILTER LINE CABLE FEATURING CONDUCTIVE FIBER SHIELDING

[75] Inventor: Mahmoud Aldissi, Colchester, Vt.

[73] Assignee: Champlain Cable Corporation, Winooski, Vt.

[21] Appl. No.: 901,633

[22] Filed: Jun. 19, 1992

Related U.S. Application Data

[63] Continuation-in-part of Ser. No. 748,146, Aug. 21, 1991, and a continuation-in-part of Ser. No. 862,871, Apr. 3, 1992, which is a continuation-in-part of Ser. No. 656,658, Feb. 19, 1991, abandoned.

[51] Int. Cl.[5] ..... H01B 7/34

[52] U.S. Cl. ..... 174/36; 174/106 SC; 174/107; 174/109; 174/110 FC

[58] Field of Search ..... 174/36, 34, 102 SC, 174/106 SC, 110 FC, 107, 109; 252/513

[56] References Cited

U.S. PATENT DOCUMENTS

| | | | |
|---|---|---|---|
| 3,191,132 | 6/1965 | Mayer | 174/36 |
| 3,616,177 | 10/1971 | Gumerman | 174/110 FC X |
| 4,301,428 | 11/1981 | Mayer | 174/36 X |
| 4,347,487 | 8/1982 | Martin | 174/36 X |
| 4,383,225 | 5/1983 | Mayer | 174/36 X |
| 4,408,089 | 10/1983 | Nixon | 174/36 X |
| 4,499,438 | 2/1985 | Cornelius et al. | 174/36 X |
| 4,506,235 | 3/1985 | Mayer | 174/36 |
| 4,532,375 | 7/1985 | Weitzel et al. | 174/107 |
| 4,626,810 | 12/1986 | Nixon | 174/110 FC X |
| 4,684,762 | 8/1987 | Gladfelter | 174/36 |
| 4,722,758 | 2/1988 | Barrett et al. | 174/110 FC X |
| 4,816,614 | 3/1989 | Baigrie et al. | 174/36 |
| 4,822,950 | 4/1989 | Schmitt | 174/36 |
| 4,920,233 | 4/1990 | Kincaid | 174/36 |
| 4,960,965 | 10/1990 | Redmon et al. | 174/36 X |
| 4,964,706 | 11/1990 | Hardin et al. | 174/110 FC X |
| 5,047,260 | 9/1991 | Durand | 427/54.1 |
| 5,103,067 | 4/1992 | Aldissi | 174/36 |
| 5,180,884 | 1/1993 | Aldissi | 174/36 |

FOREIGN PATENT DOCUMENTS

| | | | |
|---|---|---|---|
| 190939 | 8/1986 | European Pat. Off. | 174/36 |
| 1019727 | 11/1952 | Fed. Rep. of Germany | 174/36 |
| 2622297 | 12/1977 | Fed. Rep. of Germany | 174/36 |
| 244008 | 3/1987 | Fed. Rep. of Germany | 174/36 |
| 40886 | 4/1978 | Japan | 174/109 |
| 999545 | 7/1965 | United Kingdom | 174/36 |

*Primary Examiner*—Morris H. Nimmo
*Attorney, Agent, or Firm*—Salzman & Levy

[57] ABSTRACT

The present invention features a new "filter line" cable having a shield layer of metallized, high-tensile strength fibers. The filter line cable has a conductive core having a primary insulation layer. Over the primary insulation is a filtering layer made up of ferromagnetic particles (ferrite o magnetite) within a polymeric matrix such as Viton, a fluorinated elastomeric polymer. The filtering layer provides the "filter line" protection against internal RFI and microwave interferences traveling down the wire. A shield of metal-coated, high-tensile strength fibers (such as nylon, aramid, etc.) is woven or served to provide a flexible mesh layer of about 95% coverage; this is placed over the filtering layer. The shield layer provides protection against external EMI interference signals. An insulating-jacket layer is placed over the shield layer; it is made of materials such as Teflon, Kapton, fluorinated polyethylenes, carbon-filled fluorinated polyethylenes and combinations thereof, etc.

21 Claims, 3 Drawing Sheets

FILTER LINE CABLE FEATURING CONDUCTIVE FIBER SHIELDING

RELATED APPLICATION

This application is a continuation-in-part of co-pending U.S. patent applications, Ser. Nos. 07/748,146, filed on Aug. 21, 1991 and 07/862,871 filed on Apr. 3, 1992, which is a continuation-in-part of Ser. No. 07/656,658 filed on Feb. 19, 1991, now abandoned. Priority is claimed to common subject matter contained in the parent applications, and the teachings expressed therein are hereby incorporated in this application by reference.

FIELD OF THE INVENTION

The invention relates to shielding materials used in the manufacture of wire and cable and, more particularly, to "filter line" cable featuring a meshed layer of conductive fiber for shielding against external interferences. The "filter line" cable construction of the invention also features a mixture of particles of ferrite or magnetite, including "spherical" and non-spherical particles, that are integrated into and dispersed within a polymeric matrix which is used as a "filter line" layer for attenuating internal interference signals passing down the wire.

BACKGROUND OF THE INVENTION

Wire providing microwave/radar frequency attenuation is referred to in the wire and cable trade as "filter line". Some of these cables are referenced by U.S. Mil. Spec. No. Mil-C-85485. The measurement of the attenuation (insertion loss) upon a given wire's performance relates to the effect that the filter line has upon the interference signals which are conducted down the wire. Such wire and cable can also be shielded from external EMI signals by providing an overlayer of metallicized, braided or served mesh.

The ever-increasing high technology requirements of the aerospace industry demand that filter line and shielded cables be more flexible and lighter in weight. Utilizing the commercial materials that are presently available, some of the latest industry requirements cannot even be met.

This invention seeks to provide new, space-age materials in unique combinations to provide EMI, microwave and radar filtering and shielding capabilities in a wider frequency range than heretofore available. At the same time, the invention provides a cable product that utilizes thinner filtering and shielding layers, which reduces the size of the composite cable construction. In addition, the newer materials are lighter; their thinner cross-sections further reduce the weight of the finished cable product. The invention utilizes a shielding of metal-coated, high-tensile strength fibers (such as nylon or aramid) which greatly improve the flexibility and strength of the overall composite construction.

Recently, ferromagnetic particles of ferrite or magnetite have been coated with metal in order to provide conductive materials having advantageous electrical and magnetic properties. It is contemplated with this invention that these types of materials can be loaded into a polymeric matrix for use as an interference layer in the fabrication of "filter line" cable.

The filter line cable of this invention can be further shielded for outside interference signals over an extended frequency range; the shielding layer of the invention provides a layer of metallized fiber braiding, as taught by the aforementioned, parent patent application, Ser. No. 07/862,871. The metallicized fibers are woven or served into a mesh that is layered over the "filter line" attenuating layer with an approximately 95% coverage.

Properly shielded filter line provides protection against radiated EMI. Noise currents and voltages are induced on the conductors of the cables when a radiated field causes interference. Filter line can attenuate such noise when it is shielded with a metallic braid or other forms of shield layering. The shielding effect can be measured by transfer impedance techniques.

The present invention seeks to fabricate wire and cable articles that provide protection against both of the aforementioned effects, namely, attenuation of signals conducted down the wire and radiated interferences penetrating the cable.

The current invention contemplates a wire or cable construction using a layer composed of magnetic particles such as ferrites or magnetites dispersed in a polymeric matrix, such as Viton (a fluorinated elastomeric polymer manufactured by Du Pont). The magnetic particles are provided by various manufacturers, including Steward Manufacturing Company of Tennessee and Fair-Rite Products Corporation of New York. The impedance characteristics of the magnetic particles vary, depending upon the supplier, fabrication conditions and composition. Metal coating (such as silver) is provided by Potters Industries, Inc., of Parsippany, N.J.

High-frequency signals conducted down this wire are partially absorbed by the magnetic particle shield layer. The electromagnetic waves penetrate through this shield layer up to the ferrite particles and are then dissipated by lattice vibration or phonon emission. Improved protection against external interference is provided by the shield layer, as a more effective mesh layer is provided by tightly-woven or served flexible fibers. The metallized surface area comprises a silver coating on high-tensile strength fibers, made up of materials such as nylon, aramid, etc. The advantages of such a construction include cost savings, streamlined economy of size and weight, and improved flexibility and tensile strength, as compared to the conventionally shielded cable, made up of traditional metal wire mesh shields. The metal-coated fibers provide an approximately 95% coverage or better. Streamlined weight, improved flexibility and tensile strength are particularly important in view of the stringent requirements for present-day, light-weight aeronautical wire and cable.

SUMMARY OF THE INVENTION

In accordance with the present invention, there is provided a new "filter line" cable having a shield layer comprising metallized, high-tensile strength fibers. The filter line cable comprises a conductive core having a primary insulation layer. Over the primary insulation is a filtering layer made up of ferromagnetic particles of ferrite or magnetite, including mixtures of "spherical" and "non-spherical" particles, dispersed within a polymeric matrix such as Viton, a fluorinated elastomeric polymer. The filtering layer provides the "filter line" protection against internal RFI and microwave interferences traveling down the wire. A shield of metal-coated, high- tensile strength fibers comprising materials (such as nylon, aramid, etc.) is woven or served to provide a flexible mesh layer of about 95% coverage, which is disposed over the filtering layer. The shield layer provides protection against external EMI signals. An insulating-jacket layer is disposed over the shield layer; the former is composed of materials such as polytetrafluoroethylene (Teflon), polyimide (Kapton), fluorinated polyethylenes, carbon-filled fluorinated polyethylenes and combinations thereof, etc.

The wire and cable articles containing these new filtering and shield layers have extended operational frequency ranges against EMI, microwave and RFI interferences. Featuring advantages in size, weight, flexibility, cost and strength, these composite layers can also improve cables. Such improvements are in keeping with stringent, rigorous aerospace industry requirements.

The mixture compound of ferromagnetic particles in a polymer binder can be prepared by state-of-the-art compounding techniques and then molded or extruded to provide the filtering layer. The magnetic particles can be metal-coated by processes such as that described in European Patent Application, Publication No. 0 354 131 A2, by C. F. Schneider et al, entitled "Ferrite Particle Plating System and Electromagnetic Shielding", published on Feb. 7, 1990.

The metal-coated fibers of the shield layer are commercially available from E. I. Du Pont de Nemours, Inc.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

Generally speaking, the invention features, in combination, new types of filtering and shielding materials. These materials are particularly useful in the fabrication of shielded "filter line" wire and cable articles having extended operational frequency ranges. The "filter line" materials are a mixture of ferromagnetic particles comprising magnetite and/or ferrite particles dispersed within a binding polymer or a combination of binding polymers. The filtering materials can be extruded, coated, wrapped, etc., over an insulated conductive core. These particles can also be blended with other materials by state-of-the-art techniques. Other metal particles (such as particles of copper, silver, nickel, manganese, zinc, or silver-coated copper in combination with metal-coated ferrites and magnetites) dispersed within the polymer matrix may also be part of the blend formulation. A shield layer is disposed over the filtering layer. The shield layer comprises a mesh of metallicized, high-tensile strength fibers, such as silver-coated aramid, nylon, etc. Such metal-coated fibers are the product of E. I. Du Pont de Nemours, Inc.

Figure 1:
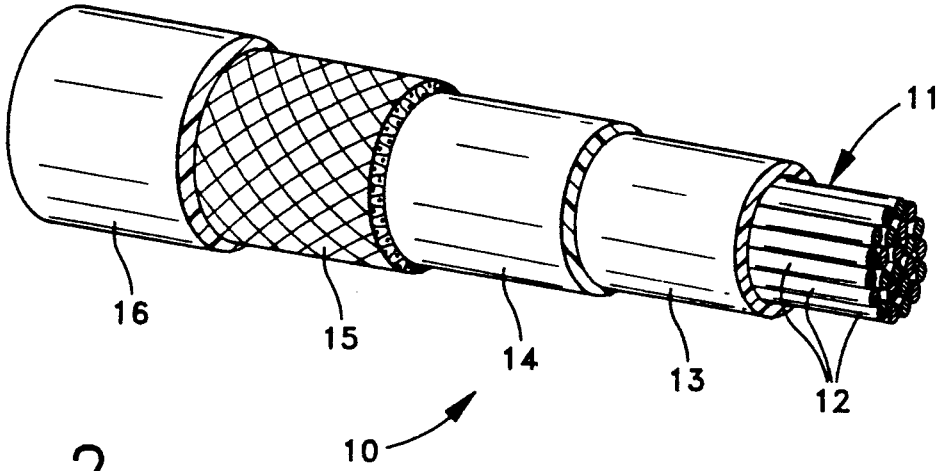
FIG. 1 illustrates a partially cut-away, perspective view of a typical, shielded "filter line" cable article, fabricated in accordance with the filtering and shield layer materials of the present invention.

Now referring to FIG. 1, a cable 10 of this invention is shown in partial cut-away perspective view. The cable 10 comprises a conductive core member 11, which contains one or more electrically conductive wires 12 of approximately 24 mils in diameter. The wires 12 can be straight-bundled or twisted together. The conductive wires 12 in a preferred embodiment are stranded wires of AWG 24 silver-plated copper alloy. The wires 12 are covered by a layer of primary insulation 13 comprising polyvinylidenefluoride (Kynar) or some other fluorinated polymer or polymers of approximately 2 mils thickness.

A filter layer 14 of approximately 4 mils thickness is disposed over the primary insulation layer 13. The filter layer comprises a mixture of silver-coated "spherical" and "non-spherical" ferromagnetic particles dispersed within and throughout a polymeric matrix of Viton, a rubberized elastomer manufactured by E. I. Du Pont de Nemours, Inc.

The ferromagnetic particles can be either ferrites, magnetites or a blend thereof. The filter layer 14 provides "filter line" function in an extended range. The matrix comprises approximately 10 to 90% by weight of the blend of materials. The metal coating on the particles can range from approximately 5% to 95% of the entire particle weight.

Disposed over the filter layer 14 is a shield layer 15, approximately 4 mils thick and comprised of lightweight metallized, high-tensile strength fiber that is braided or served into a mesh. The preferred composition of shield layer 15 comprises silver-coated aramid fiber braid, which provides an approximately 95% coverage of the filter layer 14. Other high-tensile fibers that could be used include nylon, nomex, etc.

Over the shielding layer 15 is disposed a jacket layer 16, ranging from 1.5 to approximately 5 mils in thickness. The jacket layer 16 comprises a carbon-filled fluorinated polyethylene.

Figure 2:
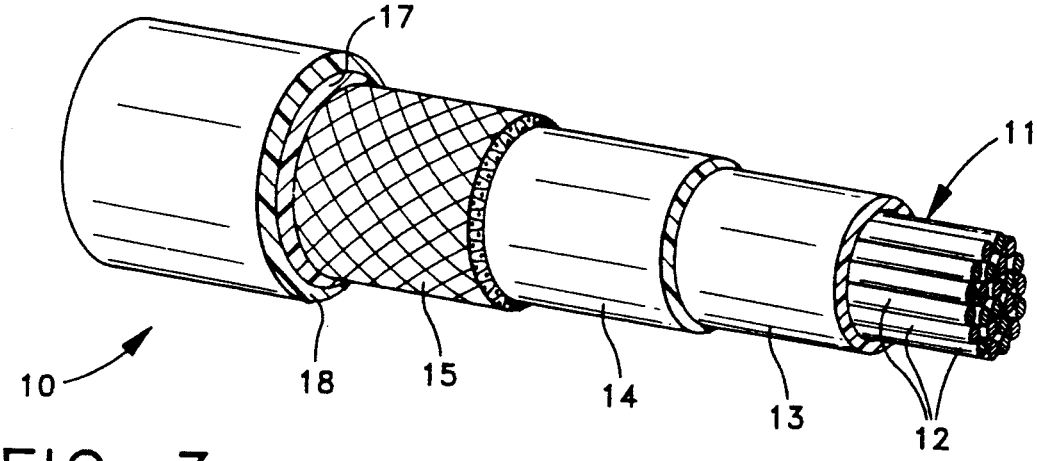
FIG. 2 depicts a first alternate embodiment of the "filter line" cable shown in FIG. 1, wherein the outermost jacket layer comprises a two-layer composite.

Now referring to FIG. 2, a first alternate embodiment of the cable 10 of FIG. 1 is illustrated. The jacket layer 16 comprising a fluorinated polyethylene is replaced by a composite of two fused layers, 17 and 18, of polytetrafluoroethylene (Teflon) and polyimide (Kapton); this composite is wrapped over the shield layer 15.

Figure 3:
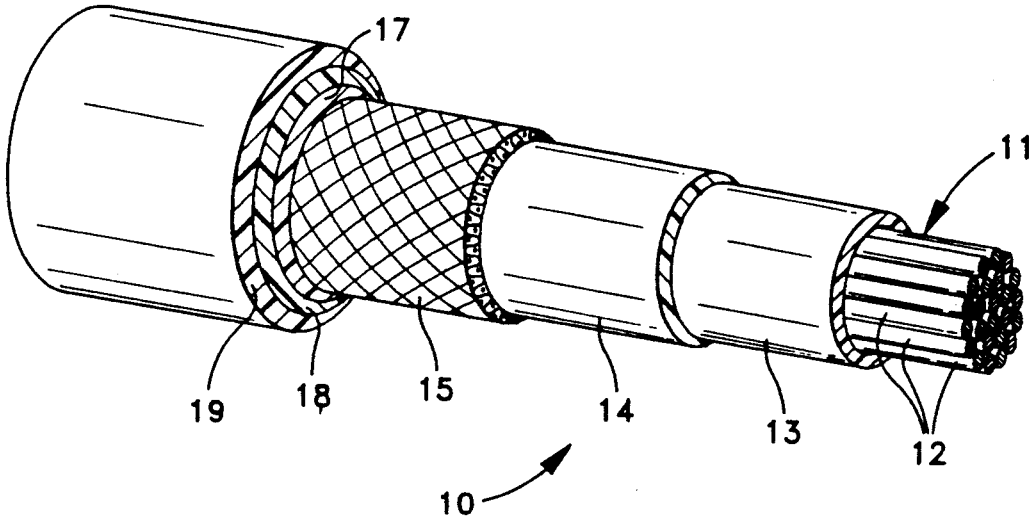
FIG. 3 shows a second alternate embodiment of the "filter line" cable shown in FIG. 1, wherein the outermost jacket layer comprises a three-layer composite.

Now referring to FIG. 3, a second alternate embodiment of the cable 10 of FIG. 1 is illustrated. The jacket layer 16 comprising a fluorinated polyethylene is replaced by a composite of three fused layers 17, 18 and 19 comprising Teflon, Kapton, and Teflon; the composite is wrapped over the shield layer 15.

Figure 4A:
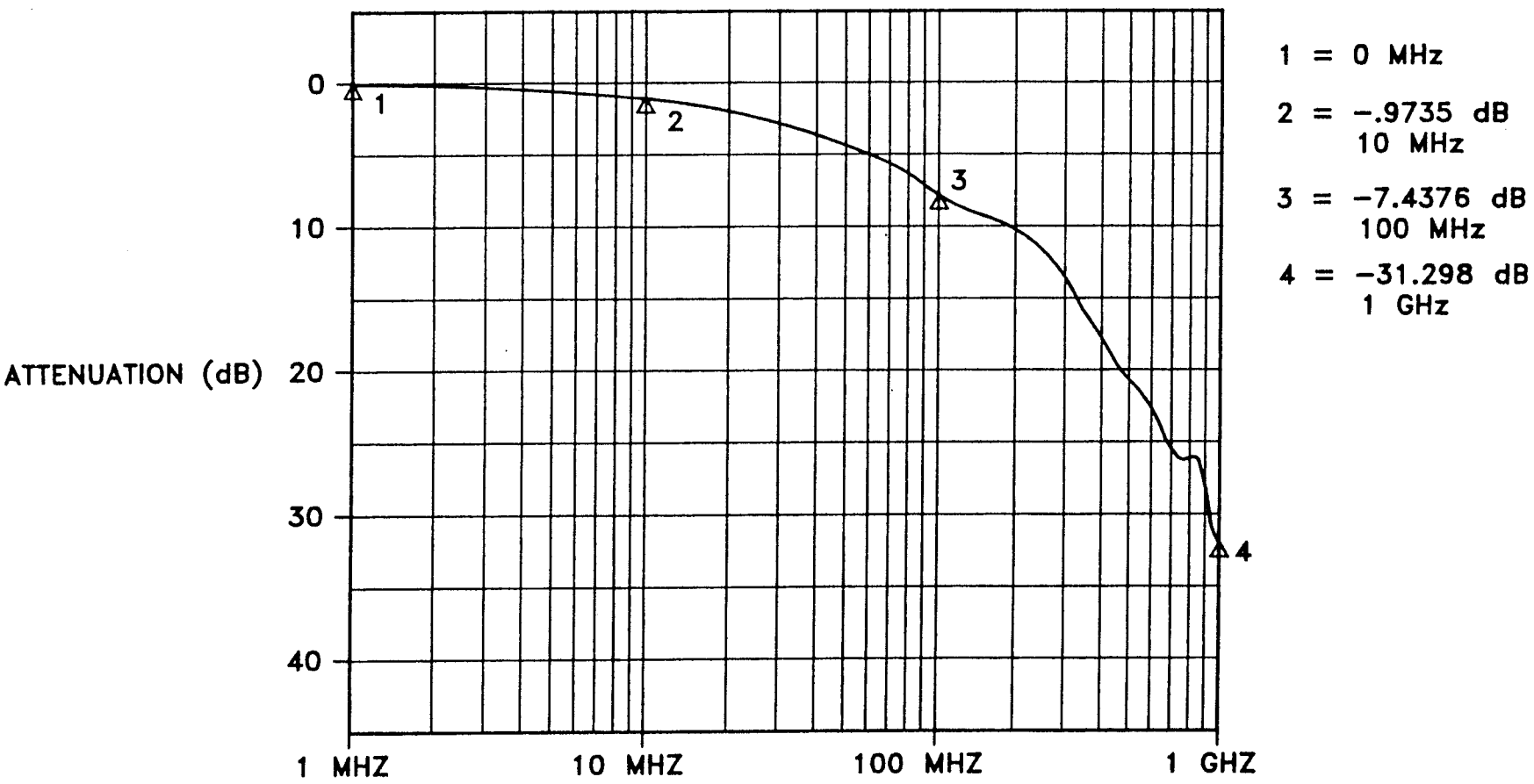
FIGS. 4*a* and 4*b* illustrate graphs of the low and high frequency attenuations achieved by the cable construction depicted in FIG. 1.
Figure 4B:
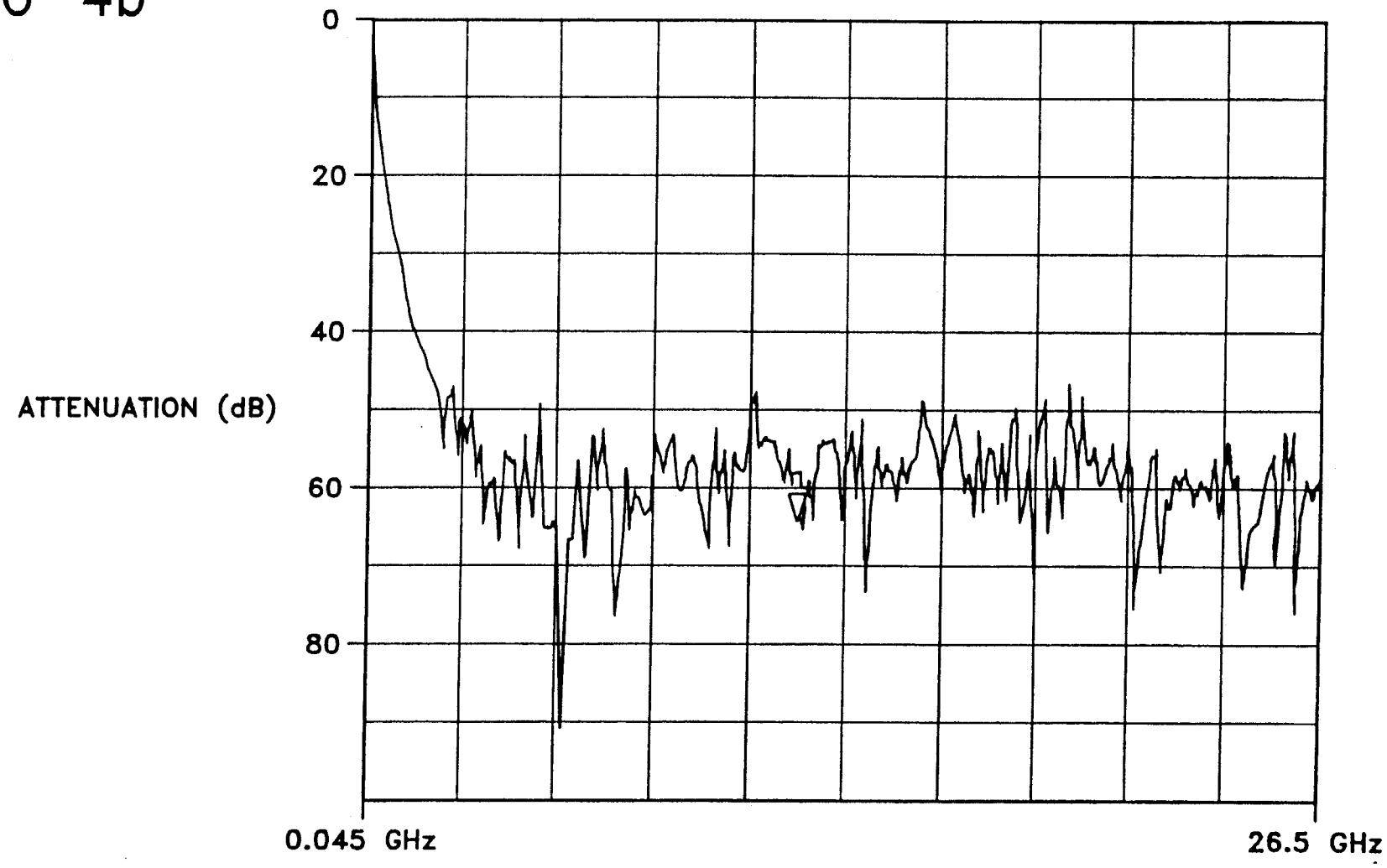

Referring to FIGS. 4*a* and 4*b*, graphs are illustrated of the low and high frequency attenuations achieved by the cable 10 shown in FIG. 1. It will be observed that the new cable construction provides attenuations in the extended frequency range between 45 MHz and 26.5 GHz.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described this invention, what is desired to be protected by LETTERS PATENT is presented by the subsequently appended claims.

What is claimed is:

1. A filter line cable having conductive fiber shielding, comprising:

a conductive core;

a primary insulation layer disposed over said conductive core;

a filter layer disposed over said primary insulation layer, including a mixture of spherical and non-spherical, ferromagnetic particles disposed in a polymer matrix;

a shield layer disposed over said filter layer, said shield layer comprising a mesh of metal-coated high-tensile strength fibers providing at least approximately 95% coverage of said filter layer; and a jacket of at least one layer disposed over said shield layer.

2. The filter line cable of claim 1, wherein said ferromagnetic particles comprise metal-coated ferromagnetic particles.

3. The filter line cable of claim 2, wherein said ferromagnetic particles further comprise particles selected from a group of materials consisting of ferrite, magnetite and combinations thereof.

4. The filter line cable of claim 1, wherein said ferromagnetic particles are coated with a metal selected from a group consisting of silver, nickel, zinc and manganese.

5. The filter line cable of claim 1, wherein said polymeric matrix comprises a fluorinated elastomer.

6. The filter line cable of claim 1, wherein said jacket comprises at least one layer of material selected from a group of materials consisting of fluorinated polyethylene, carbon-filled fluorinated polyethylene, polytetrafluoroethylene and polytetrafluoroethylene fused with polyimide.

7. The filter line cable of claim 1, wherein said jacket comprises two fused layers comprising polytetrafluoroethylene and polyimide.

8. The filter line cable of claim 1, wherein said jacket comprises three fused layers comprising polytetrafluoroethylene, polyimide and polytetrafluoroethylene.

9. A filter line cable having conductive fiber shielding, comprising:

a conductive core;

a primary insulation layer disposed over said conductive core;

a filter layer disposed over said primary insulation layer, including ferromagnetic particles disposed in a polymer matrix;

a shield layer disposed over said filter layer, said shield layer comprising a mesh of metal-coated high-tensile strength fibers providing at least approximately 95% coverage of said filter layer; and a jacket comprising fused layering of polytetrafluoroethylene and polyimide disposed over said shield layer.

10. The filter line cable of claim 9, wherein said ferromagnetic particles comprise metal-coated ferromagnetic particles.

11. The filter line cable of claim 10, wherein said ferromagnetic particles further comprise particles selected from a group of materials consisting of metal-coated ferrite, metal-coated magnetite and combinations thereof.

12. The filter line cable of claim 10, wherein said metal-coated ferromagnetic particles are coated with a metal selected from a group consisting of silver, nickel, zinc and manganese.

13. The filter line cable of claim 9, wherein said polymeric matrix comprises a fluorinated elastomer.

14. A filter line cable having conductive fiber shielding, and being operative in at least an attenuating frequency range of approximately between 1 MHz and 100 GHz, comprising:

a conductive core;

a primary insulation layer disposed over said conductive core;

a filter layer disposed over said primary insulation layer, including ferromagnetic particles disposed in a polymer matrix;

a shield layer disposed over said filter layer, said shield layer comprising a mesh of metal-coated high-tensile strength fibers providing at least approximately 95% coverage of said filter layer; and a jacket of at least one layer disposed over said shield layer.

15. The filter line cable of claim 14, wherein said ferromagnetic particles comprise metal-coated ferromagnetic particles.

16. The filter line cable of claim 15, wherein said ferromagnetic particles further comprise particles selected from a group of materials consisting of metal-coated ferrite, metal-coated magnetite and combinations thereof.

17. The filter line cable of claim 15, wherein said metal-coated ferromagnetic particles are coated with a metal selected from a group consisting of silver, nickel, zinc and manganese.

18. The filter line cable of claim 14, wherein said polymeric matrix comprises a fluorinated elastomer.

19. The filter line cable of claim 14, wherein said jacket comprises at least one layer of material selected from a group of materials consisting of fluorinated polyethylene, carbon-filled fluorinated polyethylene, polytetrafluoroethylene and polytetrafluoroethylene fused with polyimide.

20. The filter line cable of claim 14, wherein said jacket comprises two fused layers comprising polytetrafluoroethylene and polyimide.

21. The filter line cable of claim 14, wherein said jacket comprises three fused layers comprising polytetrafluoroethylene, polyimide and polytetrafluoroethylene.

* * * * *